US010500112B1

(12) United States Patent
Hanson et al.

(10) Patent No.: US 10,500,112 B1
(45) Date of Patent: Dec. 10, 2019

(54) DYNAMIC SUPPORT SYSTEM FOR A CHAIR TO PROVIDE A USER MULTIPLE SUPPORTED POSITIONS

(71) Applicants: Wayne Harvey Hanson, Bozeman, MT (US); Martin Carl Haas, Belgrade, MT (US); Mark Christopher Saunders, Bozeman, MT (US)

(72) Inventors: Wayne Harvey Hanson, Bozeman, MT (US); Martin Carl Haas, Belgrade, MT (US); Mark Christopher Saunders, Bozeman, MT (US)

( * ) Notice: Subject to any disclaimer, the term of this patent is extended or adjusted under 35 U.S.C. 154(b) by 0 days.

(21) Appl. No.: 16/005,386

(22) Filed: Jun. 11, 2018

Related U.S. Application Data

(60) Provisional application No. 62/517,706, filed on Jun. 9, 2017.

(51) Int. Cl.

| | |
|---|---|
| ***A47C 1/024*** | (2006.01) |
| ***A61G 5/02*** | (2006.01) |
| ***A61G 5/10*** | (2006.01) |
| ***A61G 5/12*** | (2006.01) |

(52) U.S. Cl.
CPC ..... *A61G 5/1067* (2013.01); *A61G 5/1081* (2016.11); *A61G 5/125* (2016.11)

(58) Field of Classification Search
CPC ..... A61G 5/1067; A61G 5/1081; A61G 5/125
USPC ..... 297/325, 326, 327, 340, 344.1, 440.1, 297/440.14, 440.15, 440.2, 440.22, 297/452.55, DIG. 4
See application file for complete search history.

(56) References Cited

U.S. PATENT DOCUMENTS

| | | | | | |
|---|---|---|---|---|---|
| 2,245,713 | A * | 6/1941 | Redmond | A47C 1/024 | 248/188.3 |
| 4,759,561 | A * | 7/1988 | Janssen | A61G 5/00 | 297/325 X |
| 4,957,302 | A * | 9/1990 | Maxwell | A47C 3/0257 | 297/325 X |
| 5,052,750 | A * | 10/1991 | Takahashi | B60N 2/2821 | 297/325 X |
| 5,110,182 | A * | 5/1992 | Beauvais | B60N 2/2821 | 297/325 X |
| 5,181,762 | A * | 1/1993 | Beumer | A61G 5/006 | 297/DIG. 4X |
| 5,785,384 | A * | 7/1998 | Sagstuen | A47C 1/032 | 297/DIG. 4X |
| 6,050,642 | A | 4/2000 | Erb | | |

(Continued)

*Primary Examiner* — Rodney B White
(74) *Attorney, Agent, or Firm* — Plager Schack LLP; Mark H. Plager; Eric Liou

(57) ABSTRACT

A dynamic support system mounted to a chair to permit a user to be supported in one of a plurality of positions is provided. The dynamic support system includes a seat assembly coupled to the chair and having a cushion and a pair of support plate assemblies coupled to the cushion, each support plate assembly having a central interface plate coupled to the chair and disposed between an inner interface plate and an outer interface plate, the central interface plate of each support plate assembly having a pair of pivot slots, the inner and outer interface plates of each support plate assembly coupled to the cushion by a pair of bolts extending through the inner interface plate, the pair of pivot slots in the central interface plate and the outer interface plate of each support plate assembly. The seat assembly can adjust between an anterior position and a posterior position.

9 Claims, 7 Drawing Sheets

(56) References Cited

U.S. PATENT DOCUMENTS 6,641,214 B2 * 11/2003 Veneruso ..... B60N 2/0232 297/325 X
7,007,965 B2 * 3/2006 Bernatsky ..... A61G 5/12 280/304.1
7,090,240 B2 * 8/2006 Papac ..... A61G 5/12 297/325 X
7,600,817 B2 * 10/2009 Kramer ..... A47C 1/022 297/354.13
7,887,132 B2 * 2/2011 Link ..... A47C 3/0257 297/327 X
8,235,407 B2 * 8/2012 Cerreto ..... A61G 5/1075 280/250.1
8,474,848 B2 * 7/2013 Bernatsky ..... A61G 5/1062 280/250.1
8,944,454 B2 * 2/2015 Blauch ..... A61G 5/1075 297/325 X
8,985,618 B2 * 3/2015 Perk ..... A61G 5/02 297/DIG. 4X
9,010,787 B2 * 4/2015 Slagerman ..... A61G 5/1075 280/250.1
9,408,763 B2 8/2016 Purdue
9,554,955 B2 * 1/2017 Blauch ..... A61G 5/1075
9,987,179 B2 * 6/2018 Melgarejo ..... A61G 5/1075
2005/0006936 A1 * 1/2005 Markus ..... A47C 1/024 297/325
2005/0029855 A1 2/2005 Hanson
2005/0077769 A1 * 4/2005 Aramburu Echeverria ..... A47C 1/025 297/327
2009/0283983 A1 * 11/2009 Horacek ..... A61G 5/10 280/250.1
2012/0080245 A1 * 4/2012 Bergman ..... A61G 5/042 297/325 X
2012/0104819 A1 * 5/2012 Line ..... B60N 2/163 297/326
2015/0374566 A1 * 12/2015 Robertson ..... A47C 1/032 297/325

* cited by examiner

DYNAMIC SUPPORT SYSTEM FOR A CHAIR TO PROVIDE A USER MULTIPLE SUPPORTED POSITIONS

RELATED APPLICATION

The application claims priority to provisional patent application U.S. Ser. No. 62/517,706 filed on Jun. 9, 2017, the entire contents of which is herein incorporated by reference.

BACKGROUND

The embodiments herein relate generally to chair support devices.

An individual's seating environment often constrains the individual from stretching, changing positions, relieving pressure, transferring from a neutral to an active position, leaning back and from entering and exiting the chair. In certain instances, a person self-propelling a wheelchair can be at a disadvantage when his/her hips are locked into position. This lack of movement can be detrimental to one's health and mental well-being. This basic need applies to able-bodied people as well as those with disabilities.

People with disabilities often have limited movement and may require special support, but they still should be given the opportunity to move to the best of their ability. There are numerous chairs that offer movement including pivoting, rocking and/or stretching as disclosed in U.S. Patent Application Publication 2005/0029855 and U.S. Pat. Nos. 6,050,642 and 9,408,763. However, these chairs do not provide one or more of the following features, which contribute to holistic health: (1) An integrated movement system that engages both the upper and lower body; (2) Transferability of the seat to numerous bases; (3) Aid in entering and exiting the chair; (4) User-activated tilt and hip angle adjustment; (5) A light-weight foldable system for transport; (6) The chair's features can be operated either by the user or the care-taker; and (7) The care-taker can lock out accessibility to operating the features from the user when it is appropriate.

As such, there is a need in the industry for a dynamic support system for a chair with enhanced user adjustability that addresses the limitations of the prior art. There is a further need for the dynamic support system to allow seating systems to provide the benefits of dynamic motion to both disabled and able-bodied individuals. There is a further need for the dynamic support system to be easily removed from the chair, transferred to alternate bases, and compactly folded for transport.

SUMMARY

A dynamic support system with enhanced adjustability mounted to a chair to permit a user situated thereon to be supported in one of a plurality of positions is provided. The chair comprises a base frame assembly disposed on a ground surface and comprising a pair of mounting tubes. The dynamic support system comprises a seat assembly coupled to the base frame assembly of the chair and comprising a cushion and a pair of support plate assemblies coupled to opposing sides of the cushion, each support plate assembly in the pair of support plate assemblies comprising a central interface plate coupled to one of the pair of mounting tubes in the chair and disposed between an inner interface plate and an outer interface plate, the central interface plate of each support plate assembly in the pair of support plate assemblies comprising a pair of pivot slots, the inner and outer interface plates of each support plate assembly in the pair of support plate assemblies coupled to the cushion by a pair of bolts extending through the inner interface plate, the pair of pivot slots in the central interface plate and the outer interface plate of each support plate assembly, wherein the seat assembly is configured to support the user on the cushion and enable slidable adjustments of the cushion between an anterior position and a posterior position as permitted by movement of each pair of bolts within the pair of pivot slots in each support plate assembly in the pair of support plate assemblies.

In certain embodiments of the invention, the dynamic support system comprises a back support assembly coupled to the base frame assembly of the chair and comprising a pair of generally upright canes and a back pad coupled to the pair of canes, the pair of generally upright canes configured to pivotably adjust to one of a plurality of locking positions to permit the back pad to support the user.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
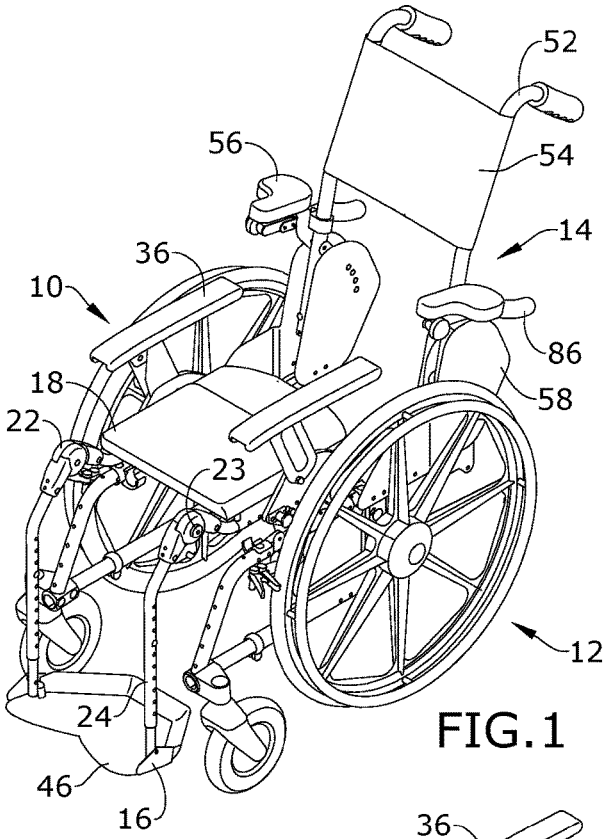
FIG. 1 depicts a perspective view of certain embodiments of the dynamic support system.
Figure 2:
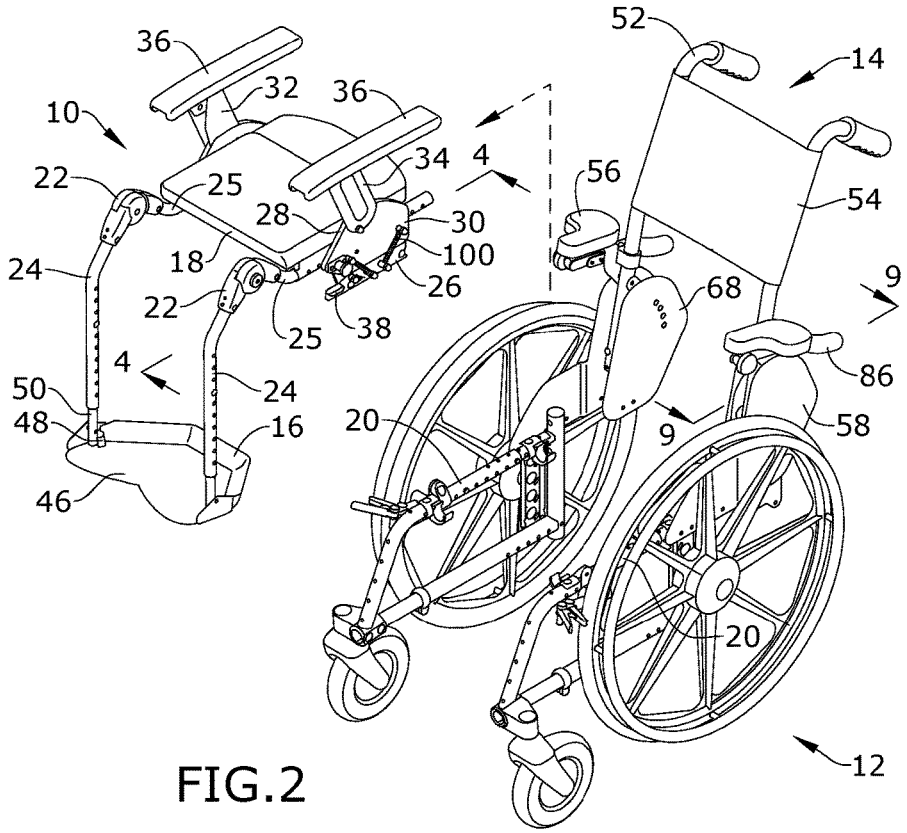
FIG. 2 depicts an exploded view of certain embodiments of the dynamic support system illustrating the removal of seat assembly 10 from the chair.
Figure 3:
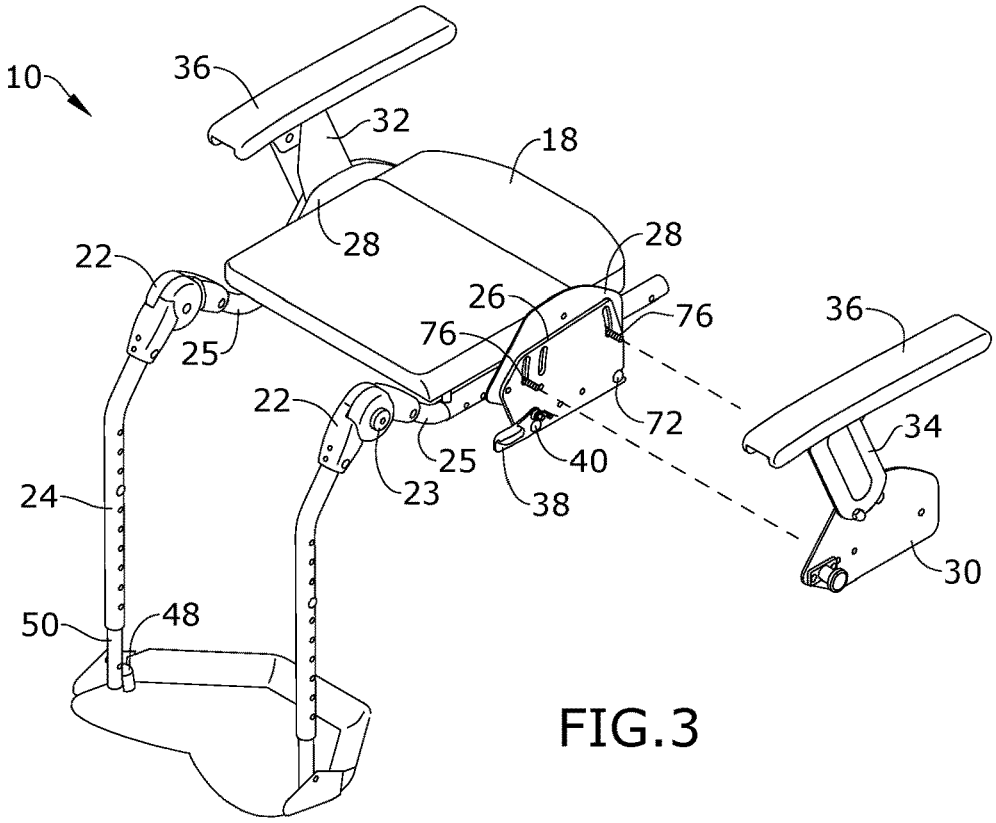
FIG. 3 depicts an exploded view of certain embodiments of the dynamic support system.

As depicted in FIGS. 1-3, the dynamic support system is configured to be mounted to a chair such as a wheelchair comprising wheelchair frame assembly 12. In certain embodiments, the dynamic support system is configured to be activated and adjusted by the user seated in the dynamic support system when mounted to wheelchair frame assembly 12. In certain embodiments, an attendant such as a care-giver can perform certain adjustments of the dynamic support system as will be described in the following disclosure.

In one embodiment, wheelchair frame assembly 12 comprises a pair of chair mounting tubes 20 oriented generally parallel to each other and connected to a plurality of wheels as is known in conventional wheelchairs. In certain embodiments, the dynamic support system generally comprises seat assembly 10 and back support assembly 14, which are both mounted to chair mounting tubes 20 of wheelchair frame assembly 12 by mechanical fasteners.

As depicted in FIGS. 2-3, seat assembly 10 generally comprises cushion 18, armrests 36, a pair of support plate assemblies each comprising inner interface plate 28, central interface plate 26 and outer interface plate 30, and a foot assembly comprising foot rest 16, foot bed 46, base tube extensions 50, lower leg tubes 24 and upper leg tubes 25.

Cushion 18 is a seating surface for the user that is made from any deformable and resilient material known in the field including, but not limited to, leather, vinyl, fabric, rubber, foam, and the like. Upper leg tubes 25 of the foot assembly are coupled to the bottom of cushion 18 using any fastening components such as mechanical fasteners known in the field. Lower leg tubes 24 are pivotably mounted to upper leg tubes 25 at angle ratchets 22. Each angle ratchet 22 comprises button 23, which is configured to lock or unlock the corresponding pair of upper leg tube 25 and lower leg tube 24. In the unlocked position, each lower leg tube 24 is configured to pivotably adjust relative to upper leg tube 25.

Figure 14:
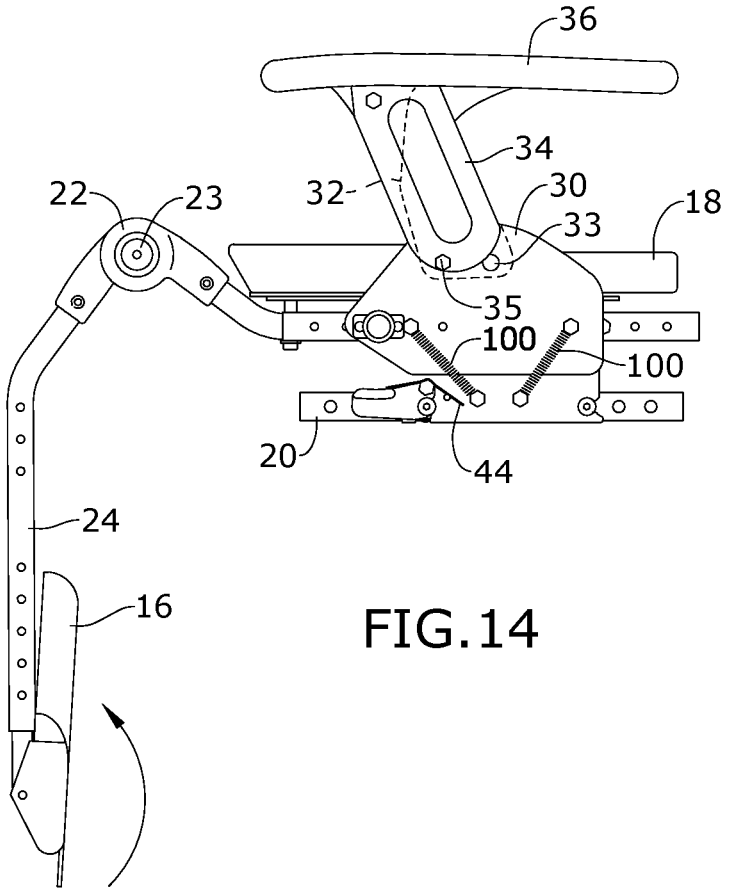
FIG. 14 depicts a side view of certain embodiments of the dynamic support system illustrating seat assembly 10.
Figure 15:
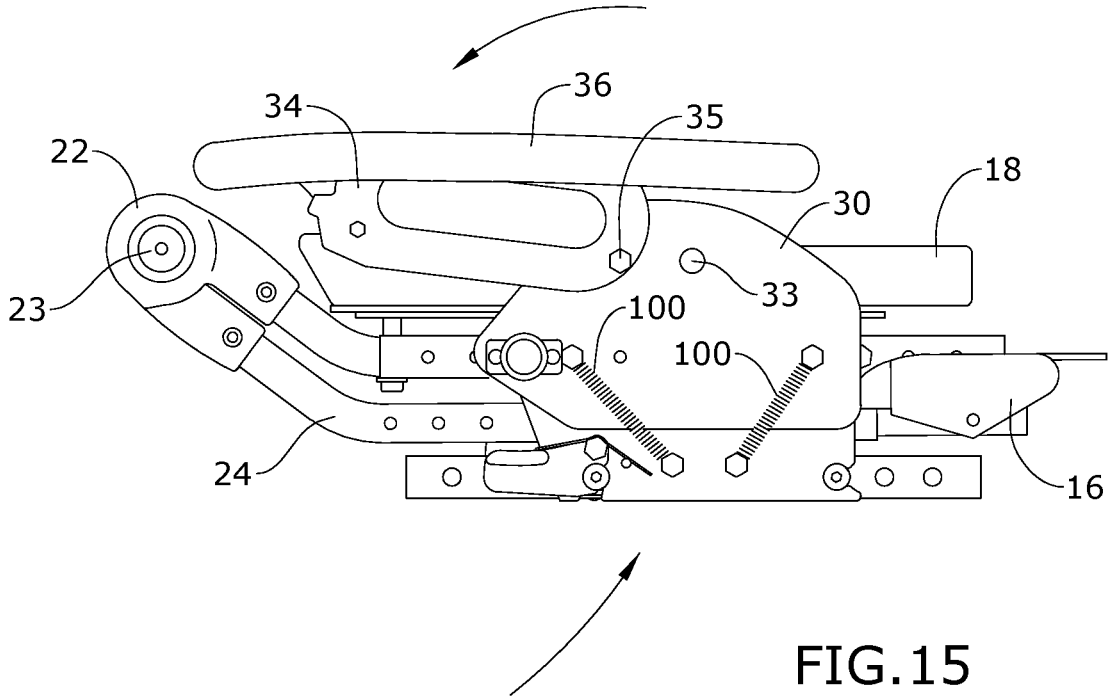
FIG. 15 depicts a side view of certain embodiments of the dynamic support system illustrating seat assembly 10.

A pair of base tube extensions 50 are slidably mounted to the pair of lower leg tubes 24. Each base tube extension 50 is configured to slidably adjust relative to lower leg tube 24 in one of a plurality of locking positions using a pin-type locking mechanism that engages with any opening in a plurality of openings disposed along lower leg tube 24. Foot bed 46 of foot rest 16 is pivotably mounted to the bottom of base tube extensions 50 and is in communication with footrest stop 48. FIGS. 14-15 depict the pivotal movement of the foot assembly to a folded storage configuration. Foot bed 46 is configured to support the user's feet when he/she is seated on cushion 18.

The pair of support plate assemblies are coupled to opposing sides of cushion 18. Each support plate assembly is attached to cushion 18 and wheelchair frame assembly 12 in the same manner. Therefore, the description of a single support plate assembly is discussed in detail for simplicity. Each support plate assembly comprises central interface plate 26 disposed in between inner interface plate 28 and outer interface plate 30.

Figure 4:
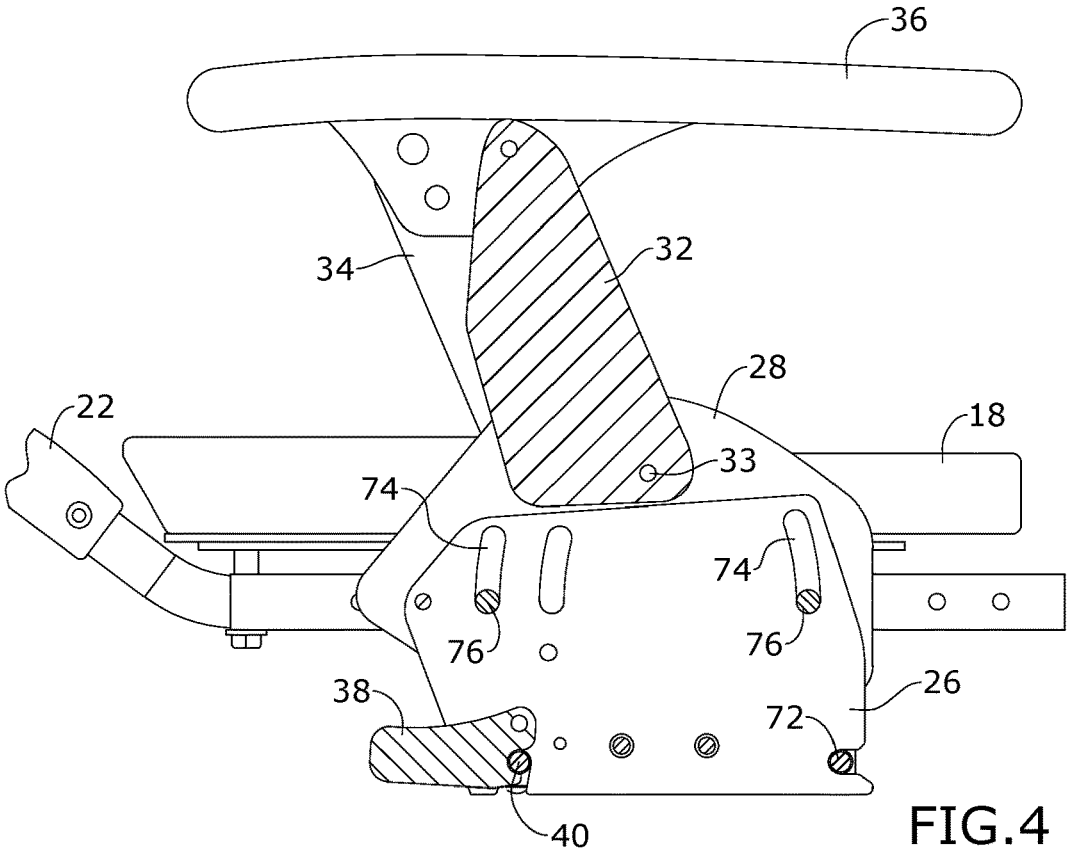
FIG. 4 depicts a section view of certain embodiments of the dynamic support system taken along line 4-4 in FIG. 2.
Figure 7:
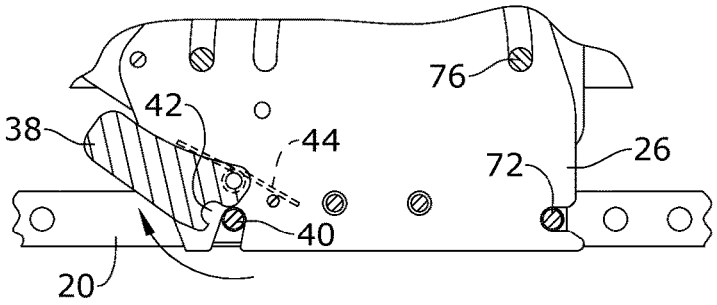
FIG. 7 depicts a section view of certain embodiments of the dynamic support system illustrating the release of latch 38.

As depicted in FIGS. 4 and 7, each central interface plate 26 comprises a plurality of pivot slots 74, which may vary in number, shape and size. Latch 38 is pivotably mounted to central interface plate 26 and is operably connected to latch-resistance spring 44. Each central interface plate 26 comprises a pair of notches configured to receive front mounting bolt 40 and rear mounting bolt 72. The central interface plate 26 of each support plate assembly is mounted to one of the pair of chair mounting tubes 20 in wheelchair frame assembly 12 using front and rear mounting bolts 40, 72.

As depicted in FIGS. 4 and 7, latch 38 is pivotably adjusted to permit front mounting bolt 40 to insert through an opening in chair mounting tube 20 and into a front notch in central interface plate 26. Latch resistance spring 44 returns latch 38 to the resting position so that latch slot 42 receives front mounting bolt 40 in the secured position as shown in FIGS. 4 and 7. Rear mounting bolt 72 is inserted through another opening in chair mounting tube 20 and slipped within a rear notch in central interface plate 26. As a result, the pair of central interface plates 26 serve as the mounting plates that attach or detach seat assembly 10 from chair mounting tubes 20 of wheelchair frame assembly 12.

As depicted in FIGS. 3-4, a pair of pivot bolts 76 couple each support plate assembly to one of the pair of upper leg tubes 25. More specifically, the pair of pivot bolts 76 extend through upper leg tube 25, inner interface plate 28, pivot slots 74 in central interface plate 26 and outer interface plate 30. In one embodiment, a pair of nuts is coupled to the ends of pivot bolts 76 and in contact with outer interface plate 30. In this configuration, inner, central and outer interface plates 28, 26, 30 are secured to upper leg tube 25. It shall be appreciated that the pair of pivot bolts 76 can be disposed in different openings in upper leg tube 25 to adjust each support plate assembly to the fore or aft positions on seat assembly 10. Further, the pair of pivot bolts 76 can extend through any combination of pivot slots 74 present in central interface plate 26 to adjust the distance seat assembly 10 slidably adjusts to the anterior or posterior position. These adjustments to the location of pivot bolts 76 help seat assembly 10 to accommodate both the size and center of gravity of the user seated on seat assembly 10.

In one embodiment, a pair of springs 100 comprise first ends coupled to outer interface plate 30 and second ends coupled to central interface plate 26 as depicted in FIGS. 14-15. Springs 100 provide additional support to each support plate assembly.

In one embodiment, a pair of armrests 36 are connected to the support plate assemblies by inner armrest plate 32 and outer armrest plate 34. Inner plate pivot point 33 and outer plate pivot point 35 permit pivotal movement of each armrest 36 to an elevated position as shown in FIG. 14 or a folded position as depicted in FIG. 15.

In operation, seat assembly 10 and wheelchair frame assembly 12 are configured to support a seated user thereon. The user seated on cushion 18 can lean forward or backward to permit seat assembly 10 to slidably adjust relative to wheelchair frame assembly 12 between an anterior position, a neutral position and a posterior position, depending on the user's desired supporting position. The slidable adjustments of seat assembly 10 are permitted by the movement of pivot bolts 76 within pivot slots 74 in central interface plates 26 of both support plate assemblies.

Figure 5:
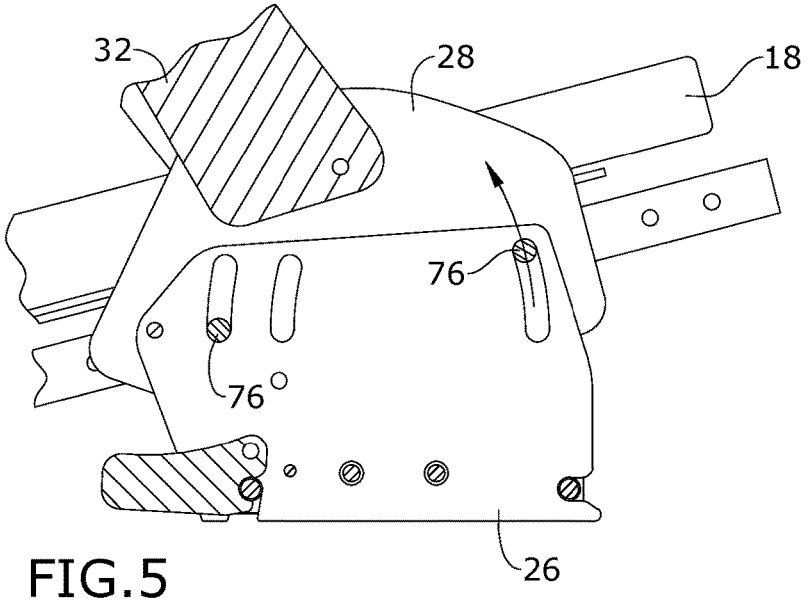
FIG. 5 depicts a section view of certain embodiments of the dynamic support system illustrating the movement of the seat to an anterior position.
Figure 6:
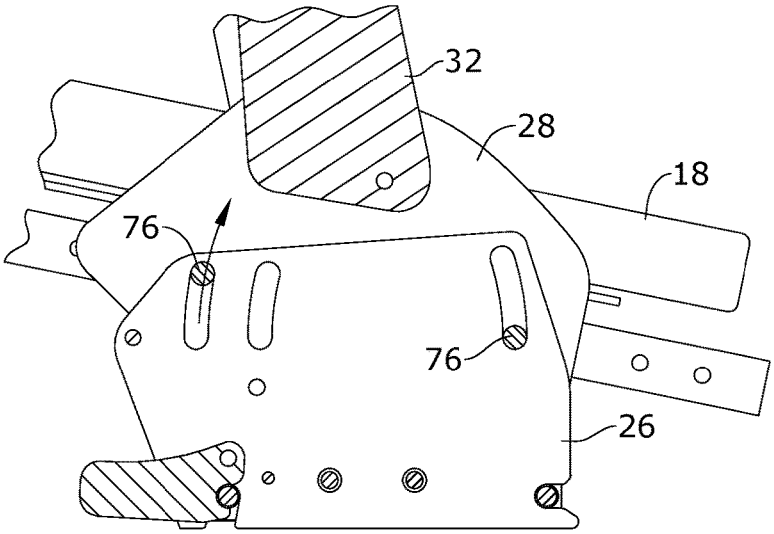
FIG. 6 depicts a section view of certain embodiments of the dynamic support system illustrating the movement of the seat to a posterior position.

FIG. 4 illustrates the position of pivot bolts 76 within pivot slots 74 of central interface plate 26 when seat assembly 10 is in the generally neutral position. FIG. 5 illustrates the position of pivot bolts 76 within pivot slots 74 of central interface plate 26 when seat assembly 10 is in the anterior position. FIG. 6 illustrates the position of pivot bolts 76 within pivot slots 74 of central interface plate 26 when seat assembly 10 is in the posterior position.

Figure 8:
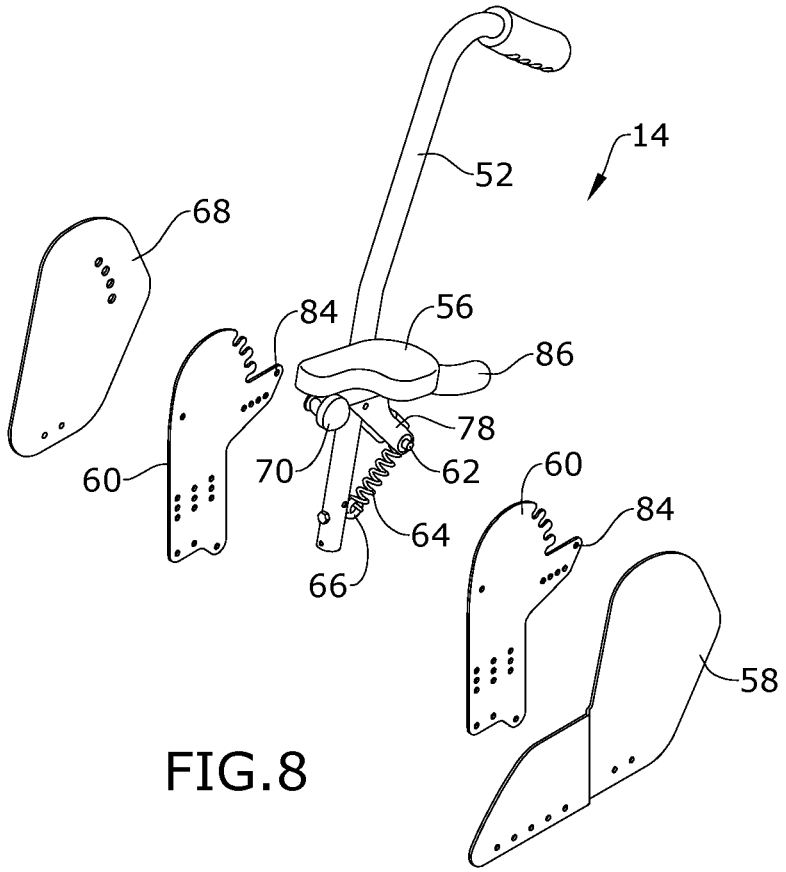
FIG. 8 depicts an exploded view of certain embodiments of the dynamic support system illustrating back support assembly 14.

As depicted in FIGS. 1-2 and 8, back support assembly 14 is coupled to chair mounting tubes 20 and generally comprises a pair of back canes 52, back pad 54, and a pair of adjustment arm assemblies with each adjustment arm assembly comprising arm pad 56, attendant adjustment handle 86 and pivot arm 78. Back pad 54 is coupled to the pair of back canes 52, which are oriented generally upright and coupled to wheelchair frame assembly 12. Each back cane 52 is coupled to wheelchair frame assembly 12 in the same manner. Therefore, a single back cane 52 and the associated assembly components are described in detail for simplicity as depicted in FIGS. 8-13.

Figure 9:
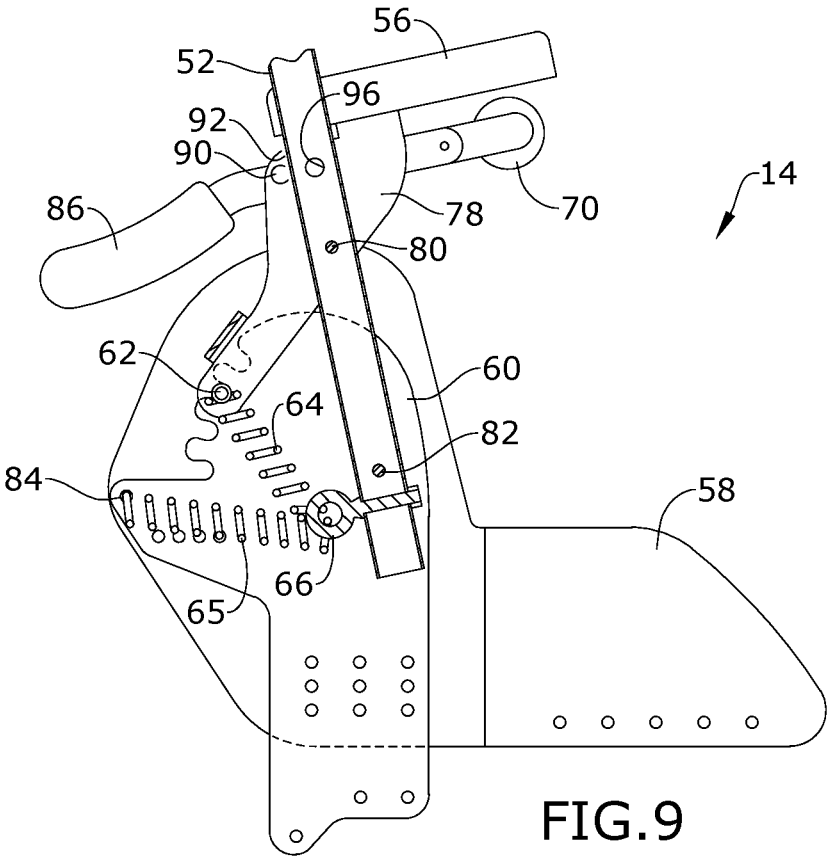
FIG. 9 depicts a section view of certain embodiments of the dynamic support system taken along line 9-9 in FIG. 2.

Each back cane 52 is pivotably mounted to a pair of notched plates 60 at pivot points 82 as depicted in FIGS. 8-9. The pair of notched plates 60 are directly coupled to one of the pair of chair mounting tubes 20 in wheelchair frame assembly 12 using any mechanical fasteners such as bolts and nuts. Outer cane plate 58 and inner cane plate 68 are coupled to the outer surfaces of the pair of notched plates 60 using mechanical fasteners such as bolts and nuts.

Each adjustment arm assembly comprises arm pad 56 coupled to both attendant adjustment handle 86 and pivot arm 78. Pivot arm 78 is pivotably mounted to back cane 52 at arm pad pivot point 80. Pivot arm 78 comprises a pair of notch pins 62 on opposing sides of the pivot arm that are configured to engage with one of a plurality of notches disposed along edges of notched plates 60. FIG. 9 depicts the engagement of notch pin 62 with one of the plurality of notches in notched plate 60.

Upper spring 64 and lower spring 65 provide resistance to the pivotal movement of pivot arm 78 relative to back cane 52 and notched plate 60 relative to back cane 52. To aid in the securement of upper and lower springs 64, 65, eyebolt 66 is coupled to the bottom of back cane 52. Upper spring 64 comprises a first end coupled to eye bolt 66 and a second end coupled to pivot arm 78. Lower spring 65 comprises a first end coupled to eye bolt 66 and a second end coupled to mounting hole 84 on notched plate 60.

Figure 10:
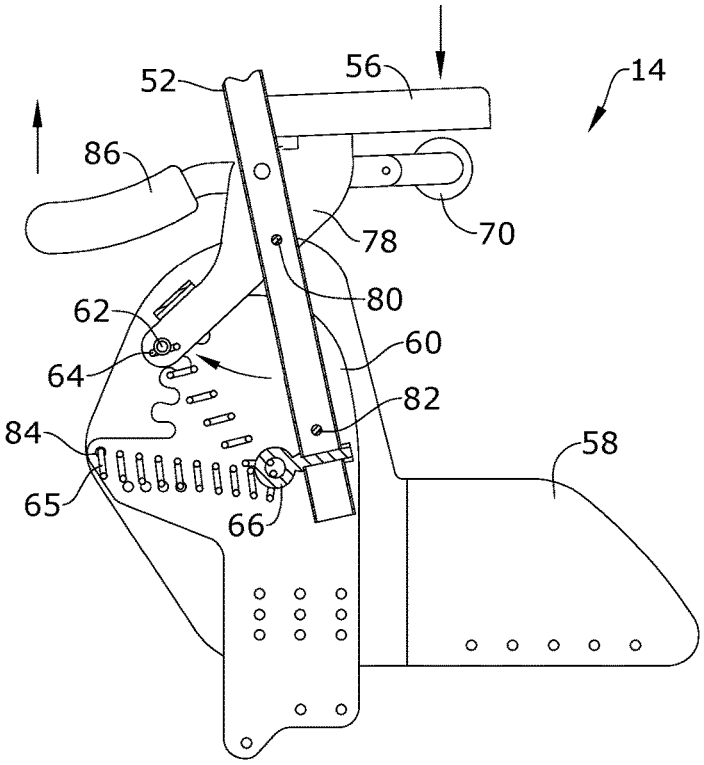
FIG. 10 depicts a section view of certain embodiments of the dynamic support system illustrating the release of pivot arm 78 when arm pad 56 is depressed.
Figure 11:
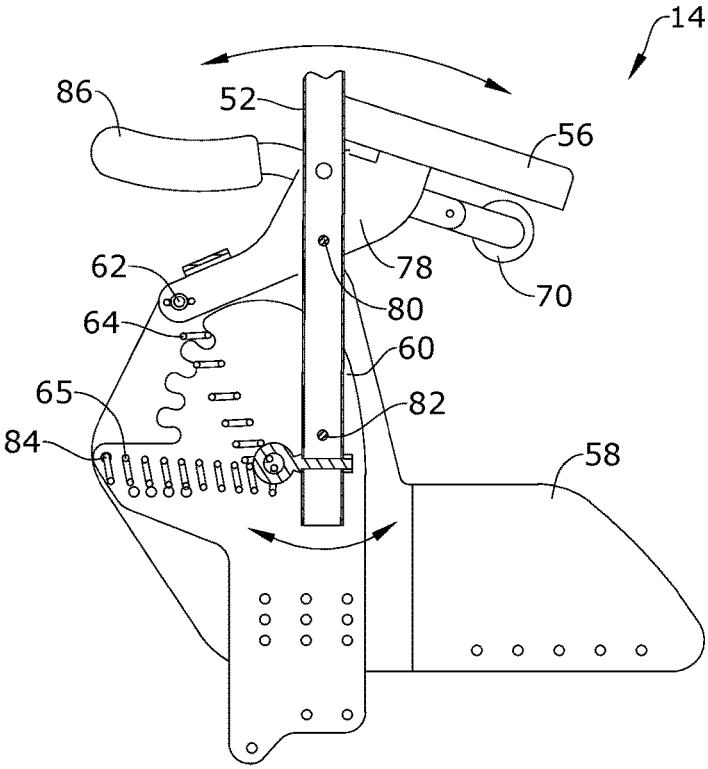
FIG. 11 depicts a section view of certain embodiments of the dynamic support system illustrating the rotation of cane 52 when released from notched plate 60.

As depicted in FIG. 10, a downward force applied by the seated user on arm pad 56 or an upward force applied to attendant adjustment handle 86 by a care-taker pivotably adjusts pivot arm 78 relative to back cane 52 at arm pad pivot point 80 to disengage notch pins 62 from notched plates 60. In this disengaged position, either the seated user or attendant can pivotably adjust back cane 52 relative to wheelchair frame assembly 12 as depicted in FIG. 11 to the desired position. Once in the desired position, back cane 52 is secured in place by maneuvering notch pins 62 back into the one of the corresponding notches in notched plates 60. The pivotal adjustment of both back canes 52 ensure back pad 54 is correctly adjusted to support the back of the user seated on cushion 18.

Figure 12:
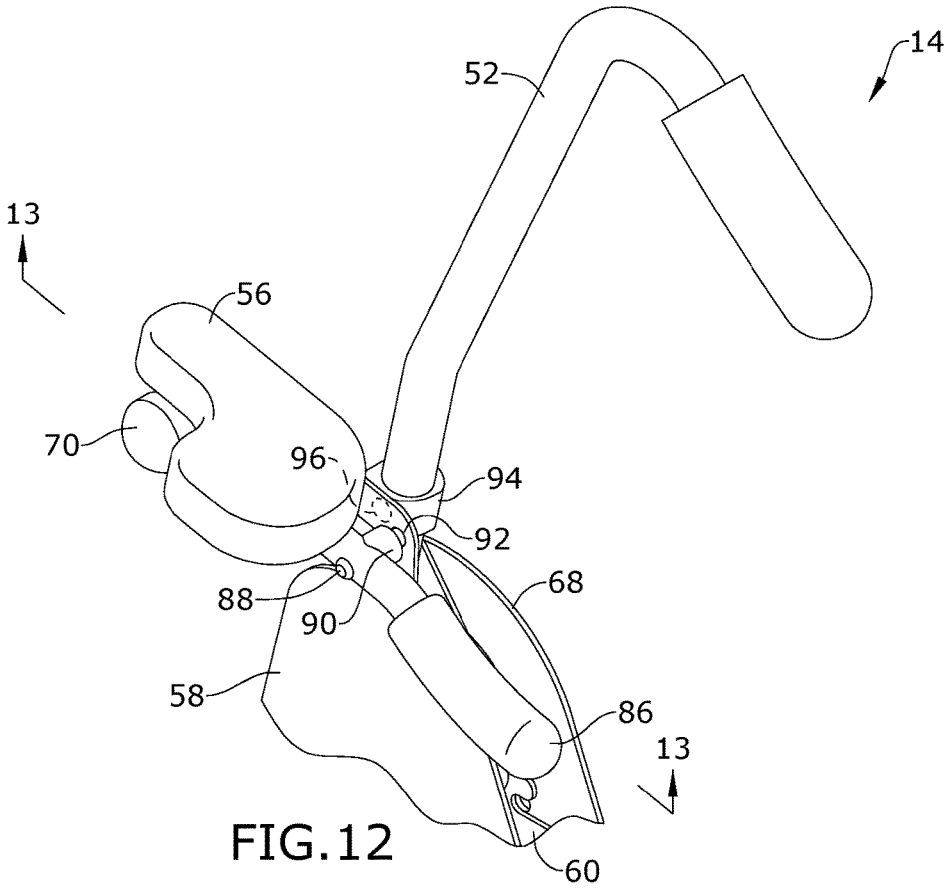
FIG. 12 depicts a back perspective view of certain embodiments of the dynamic support system illustrating back support assembly 14.
Figure 13:
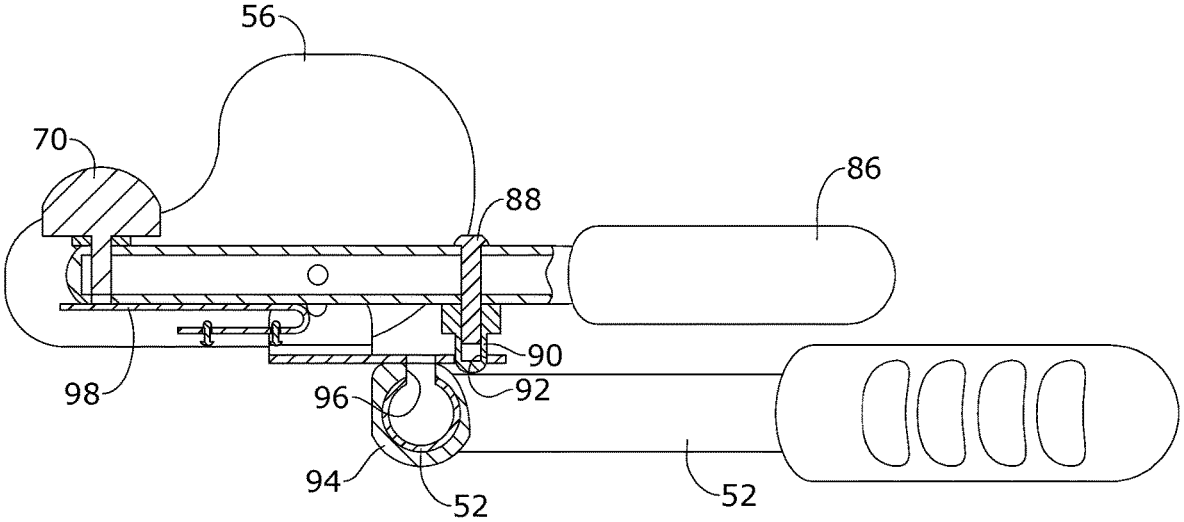
FIG. 13 depicts a section view of certain embodiments of the dynamic support system taken along line 13-13 in FIG. 12.

In certain embodiments, the pivotal adjustments of back canes 52 are not permitted unless the adjustment arm assemblies are in the correct position. FIGS. 12-13 depict certain components of each adjustment arm assembly. In one embodiment, receiver sleeve 94 is disposed around each back cane 52 and comprises sleeve hole 96. Locking pin 90 is coupled to attendant adjustment handle 86 by locking pin bolt 88. An upper portion of pivot arm 78 comprises pivot arm pin hole 92, which permits locking pin 90 to pass through. The portion of locking pin 90 that extends through pivot arm pin hole 92 and protrudes on the other side of pivot arm 78 is configured to detachably couple with sleeve hole 96 in receiver sleeve 94.

The seated user can apply a force to arm pad 56 to maneuver locking pin 90 until it engages with sleeve hole 96 in receiver sleeve 94. Alternatively, an attendant can apply a force to attendant adjustment handle 86 to maneuver locking pin 90 until it engages with sleeve hole 96 in receiver sleeve 94. Once locking pin 90 engages with sleeve hole 96 in receiver sleeve 94, the user or attendant can pivotably adjust back cane 52 to the desired position by grasping arm pad 56 or attendant adjustment handle 86. Pivotal adjustment of each back cane 52 is performed as previously described and depicted in FIGS. 10-11. Once notch pins 62 are engaged with the corresponding notches on notch plates 60 in the desired position, locking pin 90 should be disengaged from receiver sleeve 94.

In certain embodiments, button 70 is coupled to an end of attendant adjustment handle 86. As depicted in FIG. 13, tensioning device 98 is coupled to attendant adjustment handle 86 and pivot arm 78. In one embodiment, tensioning device 98 is a curved bar member that springs back to a resting position when depressed and released. In one embodiment, spacers 102 are coupled to both pivot arm 78 and tensioning device 98. The bar of attendant adjustment handle 86 is rotatably mounted to arm pad 56.

The user seated in seat assembly 10 presses button 70, which rotatably adjusts the bar of attendant adjustment handle 86 relative to arm pad 56. This rotation of attendant adjustment handle 86 retracts locking pin 90 out of sleeve hole 96 to disengage from receiver sleeve 94. Once disengaged, tensioning device 98 returns the bar of attendant adjustment handle 86 to the resting disengaged position as depicted in FIG. 12.

It shall be appreciated that the user or attendant operates both back canes 52 and adjustment arm assemblies simultaneously to pivotably adjust back pad 54 as desired. As shall be appreciated from the foregoing description, embodiments of the dynamic support system support the user seated on seat assembly 10 and wheelchair frame assembly 12 in one of a plurality of adjustment positions. The dynamic support system further aids the user to enter and exit the chair with greater ease.

It shall be appreciated that the components of the dynamic support system described in several embodiments herein may comprise any alternative known materials in the field and be of any color, size and/or dimensions. It shall be appreciated that the components of the dynamic support system described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A dynamic support system with enhanced adjustability mounted to a chair to permit a user situated thereon to be supported in one of a plurality of positions, the chair comprising a base frame assembly disposed on a ground surface and comprising a pair of mounting tubes, the dynamic support system comprising:

a seat assembly coupled to the base frame assembly of the chair and comprising a cushion and a pair of support plate assemblies coupled to opposing sides of the cushion, each support plate assembly in the pair of support plate assemblies comprising a central interface plate coupled to one of the pair of mounting tubes in the chair and disposed between an inner interface plate and an outer interface plate, the central interface plate of each support plate assembly in the pair of support plate assemblies comprising a pair of pivot slots, the inner and outer interface plates of each support plate assembly in the pair of support plate assemblies coupled to the cushion by a pair of bolts extending through the inner interface plate, the pair of pivot slots in the central interface plate and the outer interface plate of each support plate assembly; and a pair of armrests pivotably mounted to the pair of outer interface plates in the pair of support plate assemblies, each armrest in the pair of armrests configured to pivotably adjust relative to one of the pair of outer interface plates to an elevated position and a folded position;

wherein the seat assembly is configured to support the user on the cushion and enable slidable adjustments of the cushion between an anterior position and a posterior position as permitted by movement of each pair of bolts within the pair of pivot slots in each support plate assembly in the pair of support plate assemblies.

2. The dynamic support system of claim 1, further comprising a pair of spring-loaded latches pivotably mounted to the pair of central interface plates in the pair of support plate assemblies, each spring-loaded latch in the pair of spring-loaded latches configured to engage with a mounting bolt coupled to one of the pair of mounting tubes in the base frame assembly of the chair.

3. The dynamic support system of claim 2, further comprising a back support assembly coupled to the base frame assembly of the chair and comprising a pair of generally upright canes and a back pad coupled to the pair of canes, the pair of generally upright canes configured to pivotably adjust to one of a plurality of locking positions to permit the back pad to support the user.

4. The dynamic support system of claim 3, further comprising a pair of notched plates coupled to the pair of mounting tubes of the chair, each notched plate in the pair of notched plates comprising a plurality of notches, each cane in the pair of canes pivotably mounted to one of the pair of notched plates.

5. The dynamic support system of claim 4, further comprising a pair of adjustment arm assemblies coupled to the pair of canes, each adjustment arm assembly in the pair of adjustment arm assemblies comprising a secondary arm pad coupled to a pivot arm, the pivot arm pivotably mounted to one of the pair of canes and comprising a notch pin, wherein each pivot arm in the pair of pivot arms in one of the pair of adjustment arm assemblies is configured to pivotably adjust relative to one of the pair of canes to permit the notch pin thereon to engage with one of the plurality of notches in one of the pair of notched plates.

6. The dynamic support system of claim 5, further comprising a handle coupled to each pivot arm in the pair of pivot arms of the pair of adjustment arm assemblies.

7. The dynamic support system of claim 6, further comprising a first spring comprising a first end coupled to one of the pair of canes and a second end coupled to one of the pair of notched plates and a second spring comprising a first end coupled to the one of the pair of canes and a second end coupled to one of the pair of pivot arms in the pair of adjustment arm assemblies.

8. The dynamic support system of claim 7, wherein each adjustment arm assembly in the pair of adjustment arm assemblies comprises a locking pin configured to engage with one of the pair of canes, thereby permitting a force applied to the handle or secondary arm pad of each adjustment arm assembly in the pair of adjustment arm assemblies to pivotably adjust the one of the pair of canes to one of the plurality of locking positions.

9. The dynamic support system of claim 8, further comprising a foot bed pivotably mounted to the cushion of the seat assembly.

* * * * *